United States Patent [19]

Rauch

[11] 4,408,456

[45] Oct. 11, 1983

[54] FREE-PISTON STIRLING ENGINE POWER CONTROL

[75] Inventor: Jeffrey S. Rauch, Latham, N.Y.

[73] Assignee: Mechanical Technolgy Incorporated, Latham, N.Y.

[21] Appl. No.: 168,716

[22] Filed: Jul. 14, 1980

[51] Int. Cl.[3] ..... F02G 1/06

[52] U.S. Cl. ..... 60/518; 60/520

[58] Field of Search ..... 60/517, 518, 520; 62/6

[56] References Cited

U.S. PATENT DOCUMENTS

| | | |
|---|---|---|
| Re. 27,567 | 1/1973 | Baumgardner et al. . |
| Re. 29,518 | 1/1979 | Franklin . |
| Re. 30,176 | 12/1979 | Beale . |
| 2,127,286 | 8/1938 | Bush . |
| 2,157,229 | 5/1939 | Bush . |
| 2,545,861 | 3/1951 | Sallou . |
| 2,611,236 | 9/1952 | Kohler et al. . |
| 2,992,536 | 7/1961 | Carnahan . |
| 3,296,808 | 1/1967 | Mallock . |
| 3,327,675 | 8/1974 | Schuman . |
| 3,339,077 | 7/1967 | Shapiro . |
| 3,400,281 | 9/1968 | Malik . |
| 3,434,162 | 3/1969 | Wolfe . |
| 3,478,695 | 11/1969 | Goranson et al. . |
| 3,487,635 | 1/1970 | Prast et al. . |
| 3,525,215 | 8/1970 | Conrad . |
| 3,530,681 | 9/1970 | Dehne . |
| 3,548,589 | 12/1970 | Cooke-Yarborough . |
| 3,559,398 | 2/1971 | Meijer et al. . |
| 3,563,028 | 2/1971 | Goranson et al. . |
| 3,583,155 | 6/1971 | Schuman . |
| 3,597,766 | 8/1971 | Buck . |
| 3,604,821 | 9/1971 | Martini . |
| 3,608,311 | 9/1971 | Roesel, Jr. . |
| 3,645,649 | 2/1972 | Beale . |
| 3,678,686 | 7/1973 | Buck . |
| 3,733,337 | 5/1973 | Lobb . |
| 3,767,325 | 10/1973 | Schuman . |
| 3,782,859 | 1/1974 | Schuman . |
| 3,805,527 | 4/1974 | Cooke-Yarborough et al. . |
| 3,807,904 | 4/1974 | Schuman . |
| 3,822,388 | 7/1974 | Martini et al. . |
| 3,828,558 | 7/1974 | Beale . |
| 3,894,911 | 7/1975 | Cooke-Yarborough . |
| 3,899,888 | 8/1975 | Schuman . |
| 3,902,328 | 9/1975 | Claudet . |
| 3,906,739 | 9/1975 | Raimondi . |
| 3,928,974 | 12/1975 | Benson . |
| 3,937,018 | 2/1976 | Beale . |
| 3,949,554 | 4/1976 | Noble et al. . |
| 3,991,586 | 11/1979 | Acord . |
| 4,012,910 | 3/1977 | Schuman . |
| 4,044,558 | 8/1977 | Benson . |
| 4,046,018 | 7/1977 | Beale . |
| 4,058,382 | 11/1977 | Mulder . |
| 4,072,010 | 2/1979 | Schuman . |
| 4,077,216 | 3/1978 | Cooke-Yarborough . |
| 4,132,505 | 1/1979 | Schuman . |
| 4,148,195 | 4/1979 | Gerstmann et al. . |
| 4,183,214 | 1/1980 | Beale et al. . |

FOREIGN PATENT DOCUMENTS

| | | |
|---|---|---|
| 1407682 | 6/1965 | France . |
| 1539034 | 1/1979 | United Kingdom . |

OTHER PUBLICATIONS

AERE-R7693-E. H. Cooke-Yarborough "Fatigue Characteristics of the Flexing Members of the Harwell Thermomechanical Generator".

Harwell Report AERE-M2437 (Revised), Issued Mar. 1974, E. H. Cooke-Yarborough "Simplified Expressions for the Power Output of a Lossless Stirling Engine".

Harwell Report AERE-R8036, Issued May 1975, E. H. Cooke-Yarborough "Efficient Thermo-Mechanical Generation of Electricity from the Heat of Radioisotopes".

Harwell Report AERE-M2886, Issued Apr. 1977, E. H. Cooke-Yarborough "A Data Buoy Powered by a Thermo-Mechanical Generator: Results of a Years Operation at Sea".

E. H. Cooke-Yarborough, "Stirling-Cycle Thermo-Mechanical Power Sources for Remote or Inaccessible Communications Sites".

"60-Cycle AC from Sunshine, Solar Stirling Engine," Popular Science, Jun. 1978, pp. 74-77.

"Thermal Oscillators," 12th IEC Aug. 30, 1977.

"Free Piston Heat Pumps," 12th IECEC Aug. 30, 1977.

"Thermal Oscillators," 8th IECEC Meeting on Aug. 14, 1973 at Philadelphia, PA.

Report No. NO1-HV-4-2901-6 in Contract No. NO1-HV-4-2901, granted by the National Heart and Lung Institute to the University of Washington Joint Center of Graduate Studies, Report Date Aug. 1979.
"A Practical Philips Cycle for Low-Temperature Refrigeration" Walter H. Higa, Jul.-Aug. 1965, Cryogenic Technology, pp. 203-208.
"A Small Free-Piston Stirling Refrigerator" 14th IECEC, vol. 1, Aug. 5-10, 1979, A. K. DeJonge.

*Primary Examiner*—Allen M. Ostrager
*Assistant Examiner*—Stephen F. Husar
*Attorney, Agent, or Firm*—Joseph V. Claeys; Arthur N. Trausch, III

[57] ABSTRACT

A power control is disclosed for a free piston Stirling engine having a hermetically sealed vessel enclosing a working space in which oscillates a displacer for circulating working gas through a heater, a regenerator and a cooler for creating a pressure wave in the working gas which acts against a power piston for a producing power stroke. The displacer includes a post mounted in a well which forms a gas spring and cooperates with the working gas pressure wave to maintain the displacer in axial reciprocating motion. The post includes a tapered portion which reciprocates opposite a proximity probe to produce a unique signal for each axial position of the displacer to provide stroke, phase and amplitude information regarding the displacer motion. A gas spring volume control is provided, controlled by the displacer sensor, for adjusting the gas spring stiffness to control the amplitude and phase of the displacer required to produce the power to meet the engine load requirements.

31 Claims, 14 Drawing Figures

FREE-PISTON STIRLING ENGINE POWER CONTROL

BACKGROUND OF THE INVENTION

This invention relates to heat engines, and particularly to a free-piston Stirling cycle engine. Even more particularly, the invention relates to a hermetically sealed posted displacer free-piston Stirling engine driven compressor/alternator.

The conventional spark ignition internal combustion engines which are currently in widespread use in medium power applications, viz, 1–40 horsepower, are unsatisfactory in a number of respects. Although these engines are generally quite reliable and have a good power to weight ratio, the exhaust emissions of these engines contain unacceptable levels of pollutants, the engines are noisy, and the maintenance interval is too short. Most seriously, however, the currently available internal combustion spark ignition engine is so inefficient and dependent on diminishing supplies of increasingly expensive gasoline that the cost of the power it produces is becoming prohibitive.

A free-piston Stirling engine is the logical candidate to replace the internal combustion spark ignition engine in this power range. It is extremely efficient and quiet in operation. Its external combuster can accept virtually any fuel; it requires no oil lubrication, can be hermetically sealed, and requires no maintenance for extended periods of time, measured in years rather than months or weeks.

A difficulty with the free-piston Stirling engine has been in increasing its power output from the low-power applications for which it is been primarily designed, that is in the order of 5–50 watts, to a medium-power application such as a heat pump or alternator in the range of 1–10 kW and higher. The attempts to scale-up the low-power existing free-piston Stirling engines, which essentially have been laboratory curiosities, to the desired power range, reliability, and manufacturability, have been, up until now, fruitless.

SUMMARY OF THE INVENTION

Accordingly, it is a object of this invention to provide a free-piston, Stirling cycle engine which is efficient and reliable. This engine should be capable of manufacture in a variety of power output capacities above one Kilowatt and be capable of producing output power in the form of electrical, hydraulic, or heating or cooling power, or a combination of power forms to enable the device to be used as a heat pump, an alternator, a water or hydraulic pump, or other applications now powered by medium-power heat engines.

These objects are achieved in a free-piston Stirling engine having a displacer mounted on a gas bearing fixed relative to the pressure vessel. The displacer is driven by internal working fluid pressure changes produced by heat heating the working gas in a monolithic heater head and cooling it in an internally and externally finned cooler, thereby obviating all mechanical, frictional, and transfer connections between the power piston and the displacer. Power is transferred to the power piston from the pressure wave in the working gas. Stability and power modulation and distribution between the alternator and compressor is maintained and controlled by a control system.

DESCRIPTION OF THE DRAWINGS

The invention and its many attendant advantages will be understood better upon reading the following detailed description of the preferred embodiment in conjunction with the following drawings, wherein.

DESCRIPTION OF THE PREFERRED EMBODIMENT

Figures 1, 1A:
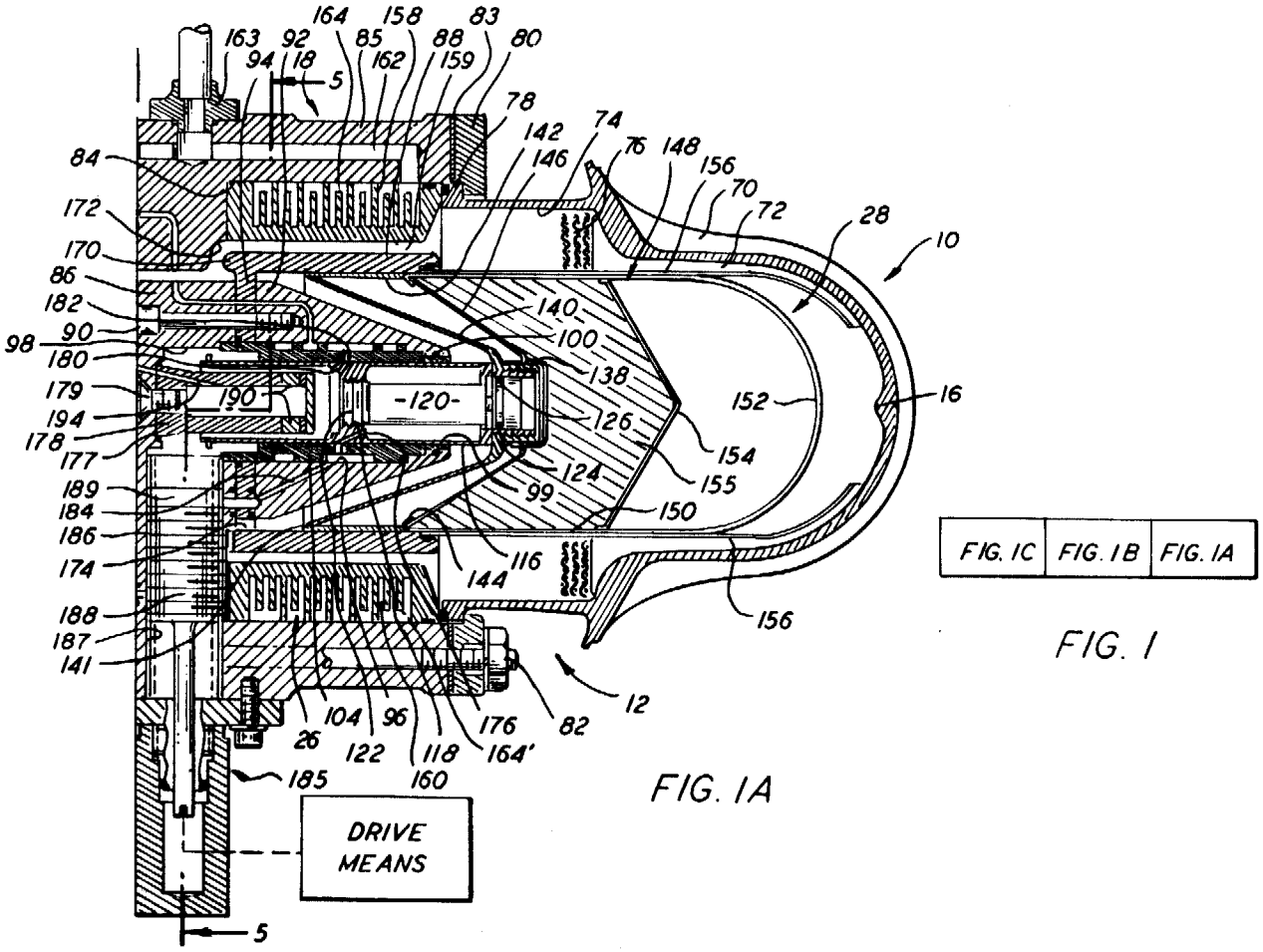
FIG. 1 is a functional block diagram showing the relationship between FIGS. 1A, 1B and 1C.
FIG. 1A is a cross-sectional elevation of the working section of a power unit made in accordance with this invention.

Referring now to the drawings wherein like reference characters designate identical or corresponding parts, and more particularly to FIGS. 1(A-C) thereof, a power unit comprising a free-piston Stirling engine powered alternator/compressor is shown. This power unit can be used in many applications where heat generated power in the range of 1 to 50 kW is needed. For example, it may be used as a heat pump when connected to suitable heat exchangers and blowers known in the art.

The power unit can be used in any orientation, and in fact is normally operated in a vertical position but for convenience it will be described as oriented in FIG. 1 with the right-hand end referred to as the "front" and the opposite end as the "rear." These terms are not to be given any limiting effect.

Figure 1B:
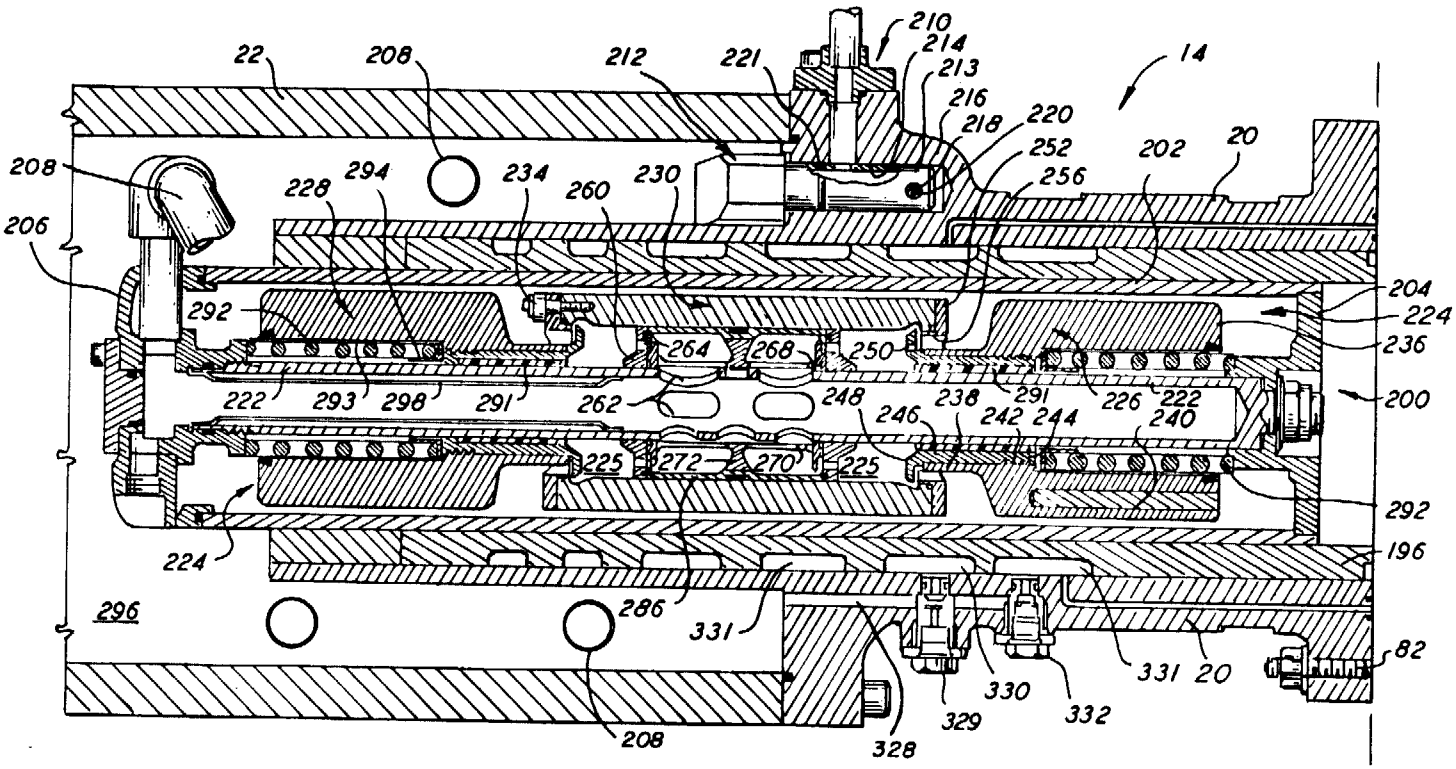
FIG. 1B is a cross-sectional elevation of the power piston of the power unit made in accordance with this invention.
Figure 1C:
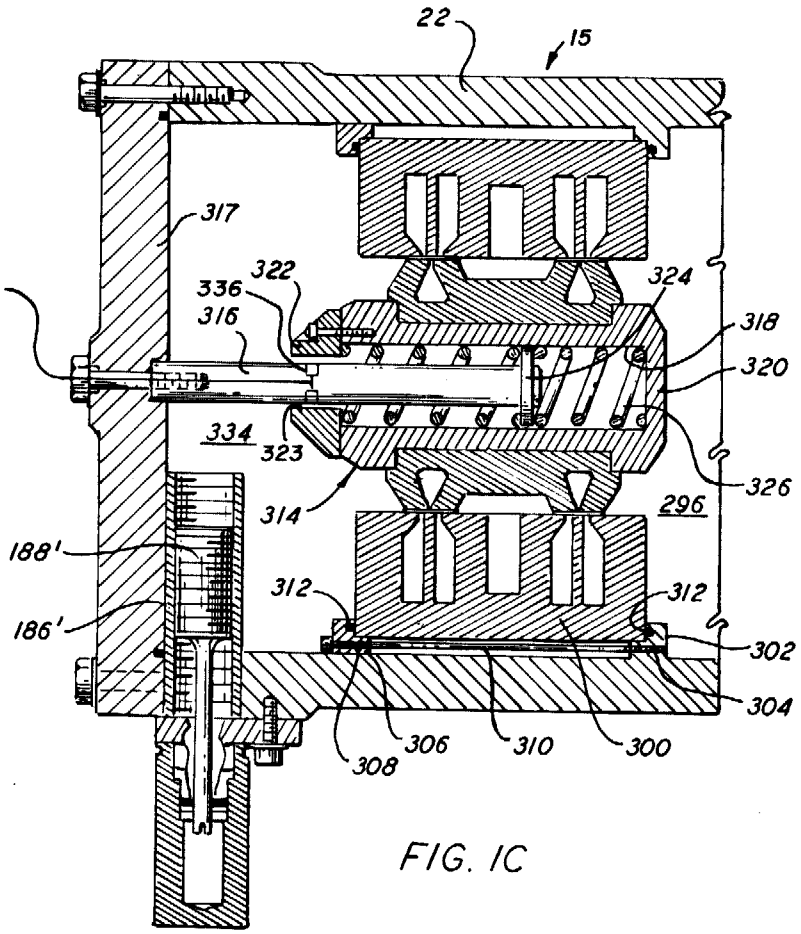
FIG. 1C is a cross-sectional elevation of the linear alternator of the power unit made in accordance with this invention.

The power unit includes an encompassing hermetically sealable pressure vessel 10 which encloses a working section 12 (FIG. 1A), a compressor section 14 (FIG. 1B), and an alternator section 15 (FIG. 1C). The working section of the pressure vessel includes a heater head 16 at the front end connected to a cooler base 18. The compressor section 14 encloses a compressor mounted in a power cylinder 20 (FIG. 1B) which is connected at its front end to the cooler base 18 of the working section 12. An alternator supported within an alternator housing 22 (FIG. 1C) is connected at its front end to the power cylinder 20. The hermetically sealable vessel 10 is thus made up of the following parts: heater head 16, cooler base 18, power cylinder 20 and alternator housing 22.

THE WORKING SECTION

The working section 12, shown in FIG. 1A, contains a working gas such as helium under high pressure, that is, from 20 to 200 bar. The function of the working section 12 is to produce a pressure wave in the working gas to drive the power elements in the power section 14 to produce output power. The pressure wave in the working gas is produced in the classical Stirling cycle by heating the gas in the regenerator at constant volume, expanding the gas in the expansion spaces at constant temperature, cooling the gas in the regenerator at constant volume, and compressing the gas in the compression spaces at constant temperature. To produce this cycle, or more precisely, a practical approximation thereof, a heater (not shown) is connected to the heater head 16, and a cooler 26 is attached to the cooler base 18. To cause the working gas to flow between the hot space inside the heater head 16 heated by the heater (not shown) and the cold space cooled by the cooler 26, a displacer 28 is disposed in the working space defined within the working section 12 of the pressure vessel 10 and; in operation, oscillates axially therein to displace the working gas to and fro between the hot and cold spaces.

The exterior of the heater head 16 is provided with axially extending fins 70 for efficient transfer of heat from the heater to the heater head 16. The interior of the heater head 16 is also provided with radially and axially extending fins 72 for efficient transfer of the heat from the heater head 16 to the working gas contained within the working space. The rear end 74 of the heater head 16 is enlarged to provide an annular space that receives a regenerator 76. The rear end of the heater head terminates in a radially extending flange 78 which is clamped to the front end of the cooler base 18 by a clamping ring 80 secured to the cooler base 18 by bolts 82. An insulating gasket 83 of ceramic or copper clad asbestos is disposed between the clamping ring 80 and the cooler base 18 to prevent heat loss from the heater head 16 to the cooler 26. A sealing "O" ring is clamped between the rear end of the heater head 16 and the cooler 26 for sealing purposes and also to minimize heat flow from the heater head 16 to the cooler 26.

The cooler base 18 has an axially extending cylindrical wall 85 which terminates at its rear end in a radially extending web 86. The wall 85 and web 86 define an annular pocket 84 which receives the cooler 26.

A cup-shaped displacer seal cylinder 88 is attached to the cooler base web 86 by four machine screws 90. The screws 90 are threaded into four tapped holes in the broad end of a cone-shaped displacer bearing housing 92 which clamps a web portion 94 of the displacer seal cylinder 88 between the cooler base web 86 and the displacer bearing housing 92.

The displacer bearing housing 92 has an axial bore 96 extending completely therethrough. An axial bore 98 also extends into the cooler base web 86 in alignment with the axial bore 96 in the displacer bearing housing 92. The front end of the axial bore 96 tapers down slightly at 99 to a smaller diameter at its opening in the apex of the cone-shaped displacer bearing housing 92. An annular groove 100 in the wall of the axial bore 96 just inside the front end of the displacer bearing housing 92 receives an O-ring seal.

Figure 3:
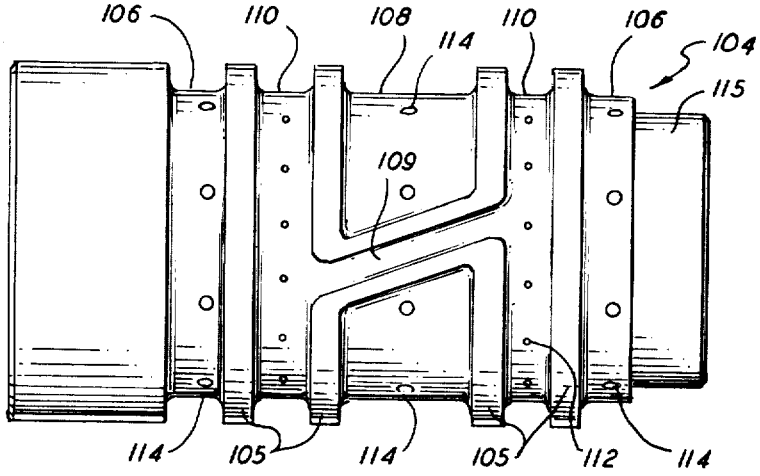
FIGS. 3 and 4 are elevations of the displacer gas bearing in the working section of the invention shown in FIG. 1A.
Figure 4:
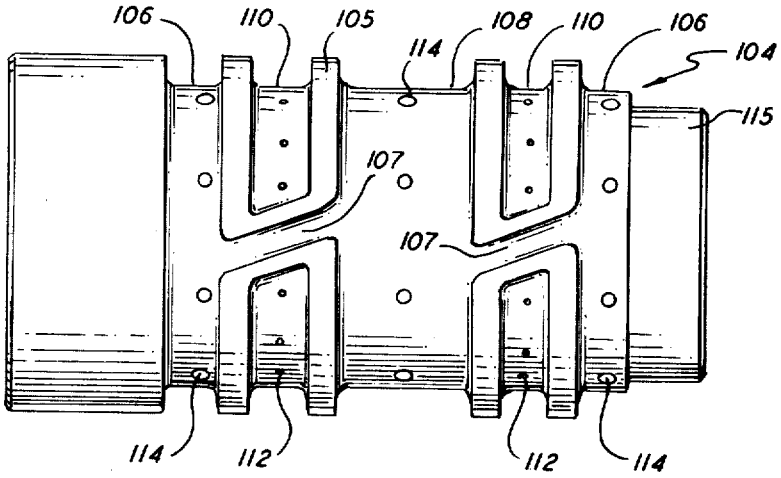

A displacer gas bearing 104, best shown in FIGS. 3 and 4, is received in the axial bore 96 in the displacer bearing housing 92 and in the forward end of the axial bore 98 in the cooler base web 86. The displacer bearing is a cylindrical member having its outer surface relieved in a pattern of broad recesses and a continuous intervening partition 105 to produce three interconnecting zones. There are two end zones 106 at the ends communicating via a passage 107 formed by the partition 105 with a middle zone 108 in the center, and there are two intermediate zones 110 on either side of the middle zone 108, interconnected by a passage 109. The middle zone 108 and end zones 106 are connected to a source of low-pressure gas. They function as a drain plenum for the gas bearing. The intermediate zones 110 are connected to a high-pressure reservoir and function as a pressure plenum for the gas bearing. A series of radial holes 112 extend from each of the zones 110 into the interior of the bearing sleeve to provide high-pressure hydrostatic lubricating gas to the gas bearing, a corresponding series of holes 114 extend from the interior of the bearing to the intermediate and end zones to act as drain portions of the bearing. The front end of the bearing sleeve 104 is necked down at 115 to fit with a snug fit into the reduced diameter portion 99 of the displacer bearing housing 92 and is sealed at that point by the annular O-ring seal in the groove 100.

Figure 2:
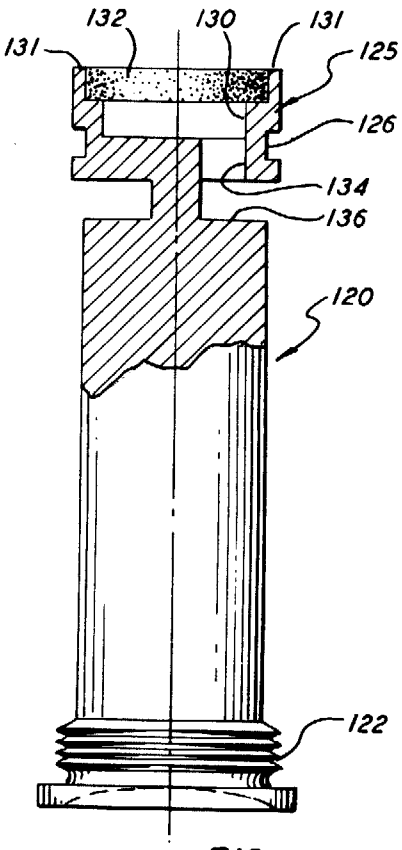
FIG. 2 is an enlarged cross-sectional elevation of the front end of the cylindrical slug 120.

The displacer 28 includes an axial post 116 slidably mounted in the gas bearing sleeve 104. The post 116 is tubular in form and includes a collar 118 at about its midpoint, which is internally threaded. A cylindrical slug 120 having an externally threaded rear end portion 122 is screwed into the threaded collar 118 and extends forward to a reduced diameter neck portion 124 of the post 116. The cylindrical slug 120 has a cylindrical front end section 125 that fits into the neck portion 124 of the post 116 with a snug fit. As shown in FIG. 2, the forward end section 125 of the slug 120 includes an annular groove 126 that receives an O-ring 128 to seal the end 125 of the cylindrical slug in the neck portion 124 of the post 116. A stepped recess 130 is formed in the forward end of the slug 120 and receives a sintered aluminum filter 132 which is secured in place, as by staking at 131. The small diameter portion of the stepped recess 130 provides a plenum behind the filter 132 which is connected by a series of axially extending holes 134 to a deep annular recess 136 which communicates with the interior of the displacer post 116 for a purpose which will appear presently.

The front end of the displacer post 116 is externally threaded and is screwed into an internally threaded collar 138 which is attached to a cone-shaped displacer end wall 140. The displacer end wall 140 is parallel to the forwardly facing cone-shaped surface of the displacer bearing housing 92 to minimize dead space in the engine working space. The displacer end wall 140 is welded at its rear edge 141 to the rear end of a displacer base wall 142 which is a heavy cylindrical sleeve. The front end of the wall 142 is formed with an upstanding end flange and a short converging conical flange 144. An interior partition 146 is welded to the conical flange and extends inwardly to the collar 138 where it is welded in place. A displacer shell 148 having a cylindrical body portion 150 and an integral dome-shaped front end portion 152 is welded to the end flange on the front end of the displacer base wall 142, enclosing the greatest portion of the volume of the displacer 28. A second conical partition 154 is welded to the inside wall of the cylindrical portion 150 of the displacer shell 148 and encloses, with the first interior partition 146, a volume which is filled with insulating material 155 such as glass wool to prevent the transfer of heat from the front end to the cool rear end.

A sleeve 156 is mounted on the front end of the displacer seal cylinder 88 and sealed thereto by an "O" ring or a continuous EB weld. The sleeve 156 extends into the heater head 16 to form a liner thereof. The sleeve 156 contacts the inner surface of the interior fins 72 and forms, with the fins, a multiplicity of axially extending spaces through which the working gas is displaced by the displacer 28 as it moves axially in the working space, thereby providing a large surface area per cross-sectional flow area ratio for effective heat transfer to the gas.

Figure 5:
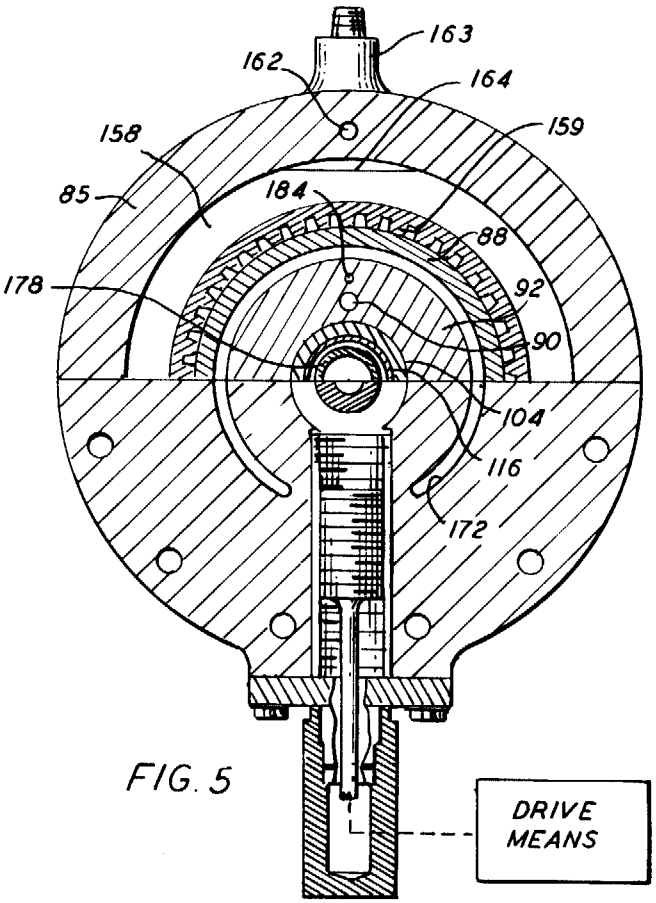
FIG. 5 is a section along lines 5—5 in FIG. 1A.

The cooler 26 is provided to cool the gas at the cool end of the working space. The cooler 26 includes a series of channels 160 defined between closely spaced laterally extending radial fins 158 for angular and stepwise axial passage of coolant from the front to the rear end of the cooler. The radial inner portion of the cooler is provided with axially extending radial vanes 159 most clearly shown in FIG. 5 which provide axial passages through which the gas passes when it flows from the regenerator 76 toward the compression space.

The angular and stepwise axial passage 160 in the cooler 26 is connected at one end to a liquid conduit 162 which is in turn connected to a source of cooling liquid such as liquid freon or water, by an external connector 163. The other end of the cooler communicates with a liquid drain (not shown). The coolant flow through the cooler is accomplished by alternately relieving the radial fins 158 with secant cuts 164 on opposite diametrical sides of the cylindrical cooler so that the coolant flows into the first interspace, around the first interspace in both directions to the point on the opposite side of the fluid inlet to where the radial fin 158 is relieved at 164. The fluid then flows into the second interspace and around the cooler in opposite directions through the second interspace to the point where the third fin 158 is relieved at 164, providing a channel for the fluid flow into the third interspace, and so on. The cooler is provided with a pair of axially facing annular grooves at the rear end and a radially facing annular groove at the front end to receive sealing O-rings to prevent coolant from leaking into the working space. The cooler is thus easily inserted into and removed from the cooler housing for ease in manufacturing and, if necessary, easy servicing or replacement.

The rear end of the displacer seal cylinder 88 is formed with an axially projecting rounded lip 170. A rounded channel 172 in the cooler base 18 communicates with the channel containing the cooler fins 159 and passes entirely axially through the cooler base to the interior of the power cylinder 20. The same rounded channel 172 communicates through a pair of arcuate openings 174, which extend through the displacer seal cylinder web 94, to the space between the displacer end wall 140 and the conical surface of the displacer bearing housing 92.

The displacer post 116 has a hole 176 which communicates between the interior of the displacer post to the center drain groove of the displacer gas bearing 104 at a certain axial position of the displacer post, for example, at the center position as illustrated. The function of this arrangement is to provide a gas flow path through the filter 132 to equalize the interior pressure of the displacer with the gas spring drain pressure. This ensures that the working gas pressure in the interior of the displacer which could tend, over a period of time, to increase because of leakage and thermal effects above the mean pressure of the working gas in the working space, will remain at acceptably low levels so that the displacer, at the low-pressure portion of the cycle, does not expand radially outward and cause it to seize in the heater head liner sleeve 156.

The displacer 28 is moved in the working space by the working gas pressure acting on the differential areas of the displacer front and rear ends, and by the displacer gas spring. The effective area of the displacer rear end is reduced relative to the effective area of the displacer front end by the cross-sectional area of the displacer post 116 where it enters the gas bearing 104. Since the pressure drop from the front to the rear end of the working space is very low, the effect of the working gas on the displacer is a net axial force tending to move the displacer toward the rear end. The instantaneous magnitude of this force, discounting the effect of the pressure drop across the regenerator, is equal to the instantaneous pressure multiplied by the area of the displacer post. Thus, during the high-pressure phase of the machine cycle, the displacer receives a force impulse tending to drive the displacer toward the compression space. The return force to return the displacer to the expansion space is delivered by the displacer gas spring, which will now be described.

A hollow plinth 178 is mounted and keyed in a recessed portion 177 of the axial bore 98 in the cooler web 86 and secured therein by a screw 179. The plinth is mounted axially in the bore and extends forwardly into the displacer post 116 and the displacer gas bearing 104. The diameter of the plinth 178 is smaller than the diameter of the gas bearing 104 and therefore there is an annular cylindrical space between the plinth and the gas bearing. The displacer post 116 extends into the space and oscillates axially therein with the axial oscillation of the displacer to which it is attached. The space defined by the rear end of the cylindrical slug 120, the external surface of the plinth 178, the outside walls of the bore 98, and the inside wall of the displacer gas bearing and the displacer post 116 define the gas spring volume. As the displacer moves toward the compression space, the gas spring volume is reduced thereby causing an increase in the pressure of the gas contained within the gas spring volume. At the lowermost point in the travel of the displacer, the gas in the gas spring volume is compressed and exerts a force on the bottom of the cylindrical slug 120 which tends to return the displacer to the expansion space of the working space.

It is desirable to adjust the characteristics of the gas spring to match the dynamics of the displacer with the other oscillating elements in the system. To this effect, a gas spring volume control 185 is provided to adjust the mean pressure of the gas spring and also the gas spring volume. The mean pressure control is necessary because leakage of gas through the displacer gas bearing into the gas spring space exceeds leakage therefrom, which results in a net pressure increase over a period of time. Therefore, a porting arrangement is provided which ports the displacer gas spring space to a reference pressure volume at a certain position in the displacer stroke. In this embodiment, the gas spring space is ported to a low-pressure volume at a position of the displacer post when the gas spring volume is, or is supposed to be, equal to the low-pressure reservoir in the system, which will be explained below. This porting arrangement is a hole 180 through the displacer post 116 which aligns with another hole 182 leading to the gas bearing drain plenum which in turn is drained to a reference low-pressure reservoir through a conduit 184 in the cooler base 18.

The gas spring volume control 185 includes a pair of radially extending, internally threaded cylinders 186 (only one of which is shown in FIG. 1) which communicate on opposite sides of the apparatus through the cooler base with the axial bore 98 in the cooler base web 86. A piston 188 having an externally threaded piston sleeve 187 to which it releasably held by an electrostatically operated clamp (not shown) is threaded into the gas spring volume control cylinder 186. The position of the piston 188 in the cylinder 186 controls the volume of the gas spring. When it is desired to increase the volume, the pistons 188 can be released to slide in the sleeves 187, or can be screwed out of the cylinders 186 by the required amount to increase the volume of the gas spring, and vice versa, as explained more fully below. The inner ends of the piston sleeves 187 are provided with a sealing collar 189 of Rulon which is externally threaded and engages the threads in the cylinders 186 with a tight and sealing fit to prevent leakage of gas out of the gas spring volume.

A displacer position sensor system is provided to give an electrical signal indicative of the axial position of the displacer in the working space for control, analytical, and troubleshooting purposes. The displacer position sensor includes a pair of proximity sensor 190 such as the Accumeasure capacitive proximity sensors sold by Mechanical Technology Incorporated of Latham, N.Y., mounted diagonally opposite each other in the front end of the plinth 178 in a position to sense the gap between the plinth 178 and the displacer post 116. The two diametrically mounted sensors are used to detect and compensate for any radial misalignment between the plinth axis and the post axis. The inside diameter of the displacer post is tapered lengthwise so that the gap between the post and the plinth varies with the axial position of the displacer in the working space. The electrical signal produced by the proximity sensors 190 is conducted through a pair of lead wires (not shown) which pass from the interior of the plinth 178 out through a hole 194, which is then potted with epoxy, and through a suitable groove and hole system through the cooler base to the exterior of the vessel.

THE COMPRESSOR SECTION

The power cylinder 20 is connected to the cooler base 18 by the same bolts 82 which hold the heater head 16 to the cooler base 18. The power cylinder contains a gas bearing 196 which is in the form of a cylinder having grooves and lands on its outside surface, similar in form to the displacer gas bearing 104, to provide gas feed and gas drain plenums. The power clyinder gas bearing 196 contains a power piston 200 which communicates at its front end with the working space of the working section of the device and is driven by the pressure wave in the working gas created by the thermodynamic Stirling cycle, to which the power piston contributes in a manner which will be described presently. The power piston 200 includes an elongated cylinder 202 closed at its front end by a front plate 204 and sealed at its rear end by a rear plate 206. The power piston front and rear plates 204 and 206 are welded to the cylinder 202 to provide a strong hermetic seal which prevents the engine working gas, which is helium or hydrogen, from entering the power piston and mixing with the heat pump working fluid, which is typically a refrigerant such as Freon R-114 but can also be other refrigerants such as ammonia, ethyl chloride, methyl chloride, sulfur dioxide, or other known refrigerants.

The power piston 200 contains a double-acting seismic compressor. Gas is supplied to and discharged from the compressor through a spring tube assembly formed of a set of four supply tubes 208 connected between the rear plate 206 and a set of gas ports 210 in the power cylinder 20. The supply tubes 208 are disposed in a helical pattern from the rear plate 206 to the gas ports 210 and function as a spring assembly as well as gas supply tubes.

The connection of the gas supply tubes 208 at the gas ports 210 is arranged to avoid prestressing any one of the tubes which could cause an imbalance in the spring force acting on the power piston and cause an undesirable lateral force to be exerted by the piston on the gas bearing 196. To prevent this force imbalance, the end of each spring tube 208 is provided with a connector 212 which includes a cylinder 213 which fits tightly within an axially extending bore 214 formed in a boss 216 on the rear end of the power cylinder 20. When the power piston 200 has been located in the gas bearing 196 at its midstroke position, and all the four gas supply tubes 208 are in their neutral unstressed position, a lateral hole 218 is drilled through the boss 216 and the cylinder 213, and a tapered pin 220 is driven into the hole 218 to hold the cylinder 213 and its connected gas tube in position. The cylinder 213 has a gas passage therethrough which communicates between the interior of the gas tube 208 and the gas port 210 in the power cylinder 20, and is sealed in the bore 214 by a sealing "O" ring 221.

The compressor assembly within the power piston 200 includes an axial tube 222 connected rigidly between the front and rear plates 204 and 206, and a "stationary" cylinder 224 slidably mounted on the tube 222. The power piston 200 and its central axial tube 222 oscillates axially in operation under the influence of the pressure wave from the working section of the power unit, and the "stationary" cylinder 224, while not literally stationary, oscillates with only a small amplitude because of its great mass and that amplitude is in phase opposition to the motion of the power piston 200. Two annular compressor compression chambers 225 are provided by the relatively moving surfaces on the axial tube 222 and the "stationary" cylinder 224. The mass of the power piston and cylinder 224 provides the necessary energy storage function which enables the Stirling engine cycle to function compatibly with the compressor cycle. That is, the instantaneous power supplied by the Stirling engine does not match the instantaneous power demands of the compressor cycle and therefore a phase shift in the power supply cycle is necessary to supply the instantaneous power demands of the compressor. This is accomplished in the inertial energy storage system provided by this arrangement.

Figure 6:
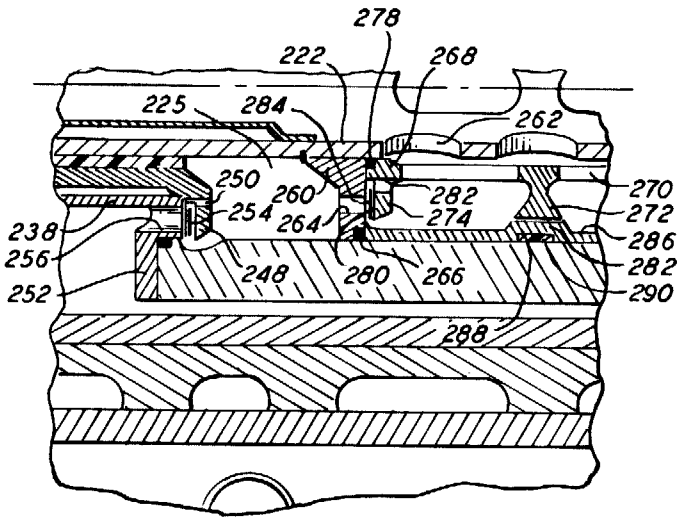
FIG. 6 is an enlarged view of a portion of the compressor shown in FIG. 1B.

The stationary cylinder 224 includes front and rear cylindrical masses 226 and 228, respectively, and a center cylindrical mass 230. The masses are connected at the rear and front ends, respectively, of the front cylindrical mass and the center cylindrical mass, and at the front and rear ends, respectively, of the center cylindrical mass and the identical rear cylindrical mass by front connection bolts (not shown) and rear connection bolts 234. These connection points also locate the suction valves for the compressor, more clearly shown in FIG. 6. The front and rear cylindrical masses are identical, one of which is reversed end-for-end relative to the other one. For this reason, only one mass will be described. The center cylindrical mass is symmetrical about its lateral midplane perpendicular to the central axis of the machine. For this reason, the front half only of the center cylindrical mass will be described with the understanding that the rear half is symmetrically identical.

The front cylindrical mass 226 includes a thick cylindrical front end portion 236 and a reduced diameter rear end portion 238. The front end portion 236 includes a series of axially extending holes 240 (only one of which is illustrated) running nearly to the rear end of the front end portion 236. Twelve such holes are formed in the member illustrated although more or fewer may be used. The holes are partially or completely filled with lead to increase the mass of the stationary cylinder 224. A short axial length of the bore of the front cylindrical mass 226 is threaded at 242 receive an externally threaded end portion 244 of a retainer sleeve 246. The retainer sleeve 246 has a rear end flange 248 in which is formed a series of arcuate slots 250. A rib 252 projects from the reduced diameter rear end portion 238 of the front cylindrical mass 226. The function of the rib 252 is to provide a mounting flange with which the bolts 234 can attach the front cylindrical mass to the center cylindrical mass and also provides a backstop for a suction valve reed 254 (shown only in FIG. 6) which is contained in the annular gap between the rear end flange 248 and the rib 252. During the suction phase of the compressor operation, the gas is drawn from the space between the "stationary" cylinder 224 and the elongated cylinder 202 through a series of holes 256 in the rib 252 and passes radially around the outside of the suction valve reed 254 supported on the rear end flange 248. The gas also passes radially inside of the annular suction valve reed 254 and through the slots 250 in the flange 248. The passage of the gas into the compression chamber thus encounters minimum resistance.

The discharge valve out of both compression chambers (best seen in FIG. 6) is on a center valve assembly which includes a pair of discharge valve seats 260 mounted on the axial tube 222 on both sides of a set of openings 262 through the axial tube 222. The discharge valve seat 260 includes a series of discharge gas passages 264 having their centers uniformly spaced around a circular center line which is concentric with the axis of the tube 222. An axially facing annular groove 266 is positioned near the outside periphery of the discharge valve seat 260 to receive a sealing O-ring for a purpose to be described below.

A tubular discharge valve retainer 268, disposed between the two discharge valves seats 266, has formed therethrough a series of radial openings 270 aligned with the openings 262 in the axial tube 222 to permit compressed gas to flow into the axial tube 222. The discharge valve retainer 268 includes a central support rib 272 and two radially extending retainer end flanges 274 adjacent to and axially facing the discharge valve seats 260. An annular recess is formed on the axially facing inner periphery of the retainer flanges 274 to receive a sealing O-ring 278, and the outer peripheral portion of the retainer flanges 274 is relieved to provide an axially facing annular ledge 280 on both axially facing ends of the discharge valve retainer which, with the adjacent axially facing surface of the discharge valve seal 260 forms an annular space which receives an annular discharge valve reed 284. A series of arcuate openings 282 are formed in the retainer flanges 274 at the inner periphery of the annular ledges.

During compression, the compressed gas flowing out of the compression chamber 225 pushes the annular discharge valve reeds 284 away from the discharge gas passages 264 in the valve seat 260 and the compressed gas flows around both radial sides of the discharge valve reed 284 over the outer periphery of the retainer flanges 274 and through the arcuate openings 282 in the flanges 274. During the suction phase of the compressor operation, the annular discharge valve reed 284 is pressed against the discharge valve seat 260 and seals the discharge gas passages 264 therethrough.

A tubular seal 286 is clamped between the outer peripheral portions of the two discharge valve seats 260 and is sealed thereto by the O-ring 266 in each of the seats 260. The axial center 282 of the tubular seal 286 is slightly thickened and has formed therein a radial groove 288 which receives a sealing ring 290 of a resilient material having a low coefficient of friction such as Teflon or Rulon. The center portion of the tubular seal 286 is radially supported by the central support rib 272 on the discharge valve retainer 268 to insure a tight seal and prevent the losses that would result from gas that is being compressed in one compression chamber leaking into the other compression chamber which would at that time be on its suction stroke. For the same purpose, a sleeve seal 291 is provided between the retainer sleeve 246 and the tube 222.

Referring back to FIG. 1B, a pair of centering springs 292 are disposed in a cylindrical recess 293 formed on the interior cylindrical surface of the front and rear cylindrical masses 226 and 228. The outer axial ends of the centering springs 292 bear against the front and rear plates 204 and 206 and the inner axial ends bear against a pair of flanged ferrules 294 which in turn bearn against the inner axial ends of the recesses 293. A radiation shield 298 is attached to the inside of the tube 222 between the discharge openings 262 in the tube 222 and the connection of the discharge tube 208 to the rear plate 206 to minimize heat transfer from the hot compressed gas in the tube 222 and the cold suction gas in the suction space between the cylinder 202 and the tube 222.

The operation of the compressor will now be described. The power piston 200 is driven in reciprocating fashion by the working gas pressure wave in the working section 12 of the power unit. The return stroke of the power piston is accomplished by energy stored in the spring tube 208 and the gas compressed in the front gas spring space 296 between the power piston and the alternator and by the energy transferred from the moving alternator armature through the gas in the front gas spring space 296. As the power piston oscillates axially in its gas bearing 196, the "stationary" cylinder 224 oscillates at about 150° out of phase with the elongated cylinder 202 and the structure fastened thereto, but with a much smaller amplitude. The heavy "stationary" cylinder 224 is sprung to the power piston with relatively soft spring 292 and is excited at a frequency greater than three times the natural frequency of the spring-mass system represented by the seismic mass of the "stationary" cylinder 224 and its centering springs 292. The damping load represented by the compressor load and the rubbing friction of the seals 290 and 291 tend to reduce the phase angle of the seismic mass and the power piston, but the reduction is less than 30°. The stroke of the seismic mass is very short in any case, so the effects of increases in the damping and spring effect represented by the compressor load, are small and are easily offset by increased stroke of the power piston produced by greater thermal input to the heater head and increased displacer stroke, resulting in a pressure wave of higher pressure amplitude.

THE ALTERNATOR SECTION

The alternator housing 22 encloses a fixed cylindrical stator 300 which is located, sealed, and secured within the alternator housing 22 by a shouldered support ring 302. The ring 302 is welded or integrally formed on the inside surface of the alternator housing 22 and has a series of axially extending tapped holes 304 formed therein. A floating shouldered guide ring 306 supports and locates the other axial end of the stator 300. The guide ring 306 includes a series of axially extending holes 308 which receive elongated bolts 310 having threaded ends which are threaded into the tapped holes 304 in the shouldered support ring 302. The guide ring 306 and the support ring 302 each include an axially facing annular groove which receives a sealing O-ring 312 for sealing the stator against passage of gas between the stator and the stator housing.

An alternator armature 314 is received in the axial cylindrical opening in the stator 300. The details of the alternator construction are disclosed in U.S. Patent Application Ser. No. Nos. 000,030, now abandoned, and 000,143, now U.S. Pat. No. 4,210,831, filed on Jan. 2, 1979. Alternatively the alternator of U.S. patent application Ser. No. 148,040 for "Linear Oscillating Electric Machine with Permanent Magnet Excitation" filed on May 7, 1980, may be used. The disclosures of these three applications are incorporated herein by reference.

The alternator armature 314 includes a centering system to ensure that the alternator armature is and remains in its axially centered position during periods of inactivity, irrespective of the orientation of the machine. The centering system includes a centering post 316 mounted on the rear end 317 of the alternator housing 22 and coaxial therewith. The centering post 316 extends into an axial well 318 in the alternator armature. The armature well 318 is closed at the front end by a front end piece 320 and a rear cone shaped end piece 322 having a central aperture 323 slightly larger than the centering post 316 is fastened to the rear end of the alternator armature 314. A spider 324 is fastened to the front end of the centering post 316. The arms of the spider 324 extend radially outward to adjacent the walls of the axial well 318. A pair of centering springs 326 are biased between the spider 324 and the two end pieces 320 and 322 to provide a biasing force which is balanced at the centered position of the armature to center the armature in the stator 300.

The space between the rear end plate 206 of the power piston 200 and the front end of the alternator armature 314 is filled with engine working gas which can be helium or hydrogen. The operation of the machine causes the power piston 200 to reciprocate axially, producing a pressure wave in the working gas in the front gas spring volume 296. The pressure wave in the front gas spring 296 is the forcing function on the alternator armature 314 which reciprocates axially under the influence of the pressure wave lagging the power piston motion by about 160°-170°. The pressure wave also charges a high-pressure reservoir 330 which supplies the displacer and power piston gas bearings. The high-pressure reservoir 330 is charged through a gas conduit 328 running from the front gas spring space 296 to the high-pressure reservoir 330. The gas conduit is controlled by an adjustable check valve 329 which, under control of the conduit system to be described, allows pressurized working gas to enter the high-pressure reservoir 330 during pressure peaks in the front gas spring 296. Likewise, the low-pressure valleys in the front gas spring 296 are used to evacuate a low pressure reservoir 331 through a low-pressure reservoir check valve 332 to provide a low-pressure reservoir into which the gas bearing can drain. The front gas spring 296 also functions as an essential part of the dynamic system which includes the displacer, the engine working space, the power piston, the front gas spring 296, the alternator armature 314, and the rear gas spring 334 which is the space between the alternator and the rear end of the alternator housing 22.

Since the armature 314 is driven exclusively by the gas pressure in the front gas spring 296, it is important to minimize gas leaks between the front and rear gas spring volumes through the radial "air gap" between the radially facing surfaces of the alternator armature and stator. This "air gap" is typically 0.100 to 0.010 inches which would present a significant leakage flow path that would adversely affect the operation of both gas springs and the entire dynamic force cancellation system. Moreover, the armature centering post is not designed to act as a radial bearing, so a radial bearing must be provided to radially support and center the armature in the stator. For these purposes, the stator bore and the armature pole faces are coated with a hard, low-friction, insulating ceramic coating such as aluminum oxide and then overcoated with a soft, low-friction, inslulating coating such as Teflon. The total thickness of the coating as applied is slightly greater than the alternator "air gap." When the alternator is assembled, the coating will wear to a zero clearance fit and provide a gas-tight seal that also radially supports and centers the armature.

The operating point of the machine is a function of the following parameters: (1) the pressure change of the working gas in the working section 12 over the engine cycle, (2) the mass of the moving components, (3) the spring rate of the gas and mechanical springs, and (4) the damping afforded by the alternator and compressor.

This operating point will change over the year in certain applications, such as a heat pump for example, when seasonal climatic changes affect the operating parameters. The load on the compressor will be high when the temperature is hot and cold, and the alternator load will vary seasonally and also depending on the power requirements of the equipment to which it is connected. These changes of operating point will change the dynamic relationship of the moving parts so that the inertial forces do not cancel. Accordingly, it would be desirable to adjust the machine so that the shaking forces of its oscillating masses cancel at its mean operating point. To this effect, a variable volume cylinder 186' and piston 188' of similar construction to the cylinders 186 and pistons 188 in the working section are provided at the rear end of the power section to alter the effective volume and hence the spring constant of the rear gas spring 334. A large change in the spring constant is needed in some loading conditions and, therefore, a large volume change is provided by multiple and/or larger volume changing means, represented by the single piston 188' and cylinder 186' illustrated in FIG. 1C.

The volume and pressure of the front gas spring volume 296 are selected to produce a spring constant that will drive the alternator armature 314 with a large lag angle, on the order of 160°-170°. Because the alternator armature is a power dissipating mass, it will not lag by a full 180° but somewhat less than that. However, the power piston itself lags the displacer by 40°-80° so the displacer-power piston phasor leads the alternator phasor by an angle closer to 180°. The mass of the alternator armature is made close to the mass of the power piston-displacer phasor so that the shaking forces that these oscillating masses would normally transmit through the pressure vessel and the mounting hardware to ground are substantially reduced and, in some operating conditions, canceled entirely.

The operating conditions will affect the phase relationships of the masses, which will produce changes in the resultant inertial force exerted by the dynamic system on the vessel. For example, when the alternator load increases, its angle of lag will increase. In addition, an increased load on the alternator will often be accompanied by an increasing load on the compressor, which will increase the power piston phase angle with the displacer. Both of these effects tend to bring the angle of lag of the alternator armature behind the power piston-displacer phasor closer to 180°, thus increasing the cancellation of the oscillating masses.

Figure 7:
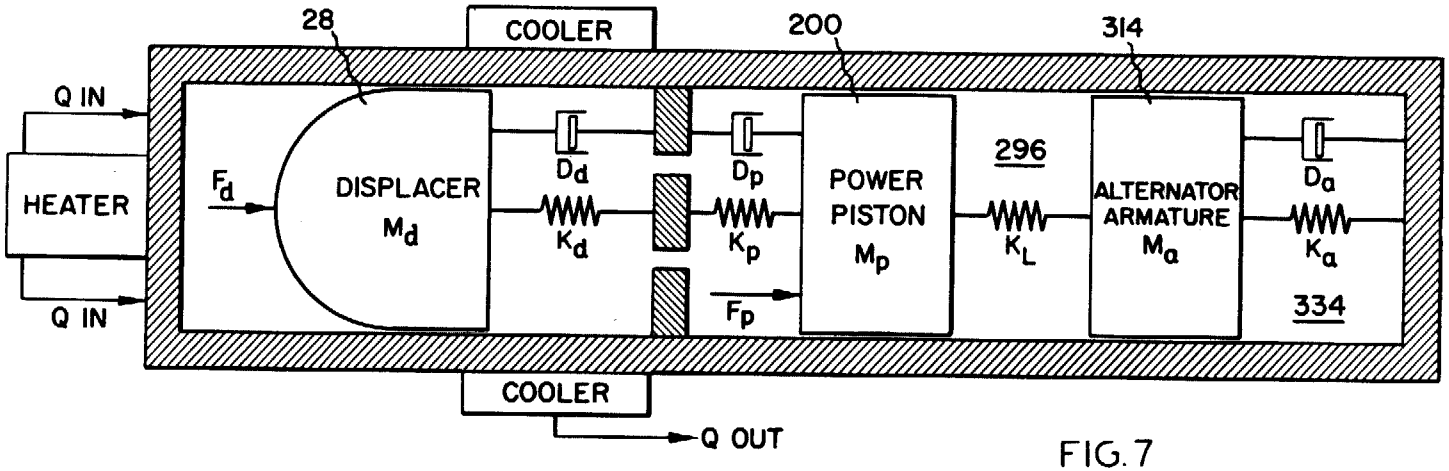
FIG. 7 is a schematic of the spring-mass system of this invention.
Figure 8:
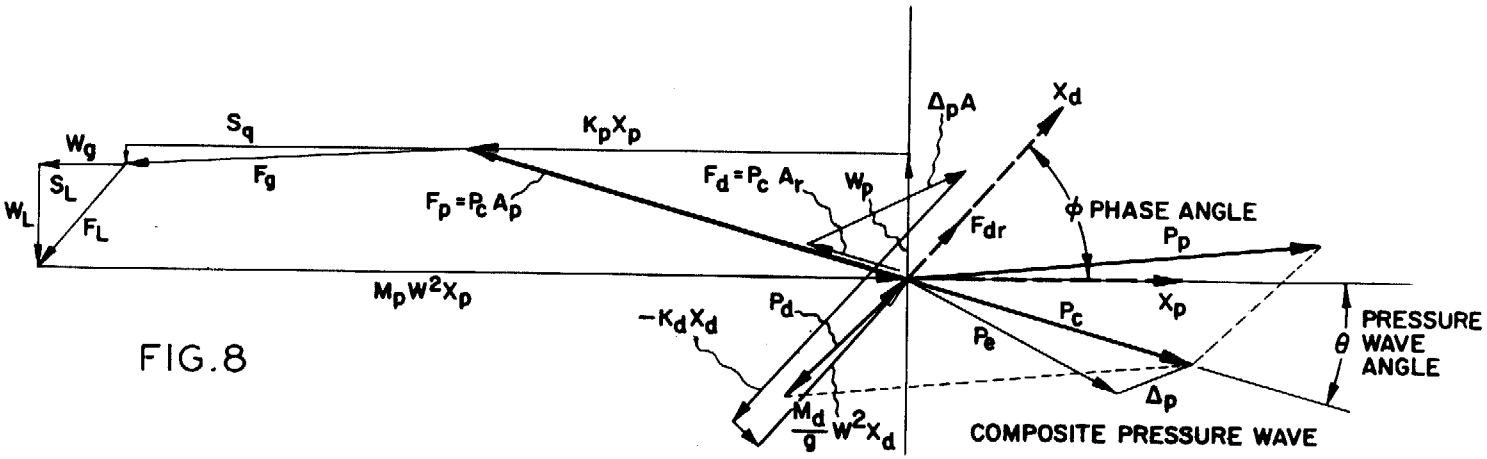
FIG. 8 is a phasor diagram of the oscillating masses of a power unit made in accordance with this invention.

The dynamic system is shown schematically in FIG. 7, and the corresponding phasor diagram is shown in FIG. 8. The purpose of utilizing gas springs to drive the alternator armature 314 is to provide a means for balancing the inertial forces of the moving masses of the system so that the inertial forces tend to cancel rather than transfer to the vessel and thence to the support structure such as the floor of a building. This enables the mounting hardware to be much smaller, simpler, and less expensive than would be the case if the full shaking forces of the moving masses within the vessel were transmitted to ground.

CONTROL SYSTEM

The control system will now be described in conjunction with a brief description of the ideal thermodynamic operation of the machine. As in other Stirling cycle engines, the working gas experiences the following thermodynamic processes in the course of one cycle of operation: isothermal compression at a low temperature in the compression space; constant volume heating in the regenerator; isothermal expansion in the expansion space; and constant volume cooling on its return trip through the regenerator.

The cyclic heating and cooling of the working gas as it shuttles between the heater and cooler through the regenerator causes a pressure wave which acts on the displacer to maintain displacer motion, and on the power piston to produce output power.

Since the displacer is mechanically and frictionally independent of the power piston, its movement is determined solely by the gas pressure and damping forces acting on it. Likewise, the power piston motion is determined by the gas pressure and damping forces acting on it. The damping forces include friction, gas leakage, hysteresis, and the load forces exerted by the compressor and alternator loads.

The dynamics of this relationship are illustrated schematically in FIG. 7. The displacer 28 is driven toward the cold end by a force Fd representing the working gas pressure wave acting on the displacer rod area Ar, and is driven back toward the hot end by the displacer gas spring Kd. The power piston is driven by the working gas pressure wave force Fp acting on the full face of the power piston. The enclosed volume of working gas also acts like a gas spring Kp on the power piston. The gas spring Ki of the front gas spring volume 296 links the power piston 200 and the alternator armature 314, which in turn is sprung to the hermetic case by a gas spring Ka of the rear gas spring volume 334. These springs are all gas springs which provide high spring constants with low weight and volume requirements.

Each of the moving components has a damping effect associated with its movement: the displacer dissipates energy in shuttling gas back and forth through the heat exchangers; the power piston transfers energy into the compressor; the alternator transfers energy into the stator windings. In addition, there are friction, leakage, and hysteresis losses associated with these movements. These damping components are illustrated schematically as Dd, Dp, and Da respectively. The magnitude of the damping components varies as a function of the load combinations applied to each moving component throughout the system operating regime. The control system must compensate for these load variations to maintain stable system operation and useful lower modulation.

One useful technique for analyzing the relationship of the motion of the engine components and the forces exerted thereon is the phasor diagram, shown in FIG. 8. The relative positions of the phasors will vary slightly over the cycle, but for the purposes of this discussion they will be assumed to remain constant. In fact, the error in assuming a constant relative position of the phasors is only about 0.5% of the true value.

The displacer displacement phasor Xd is shown leading the power piston displacement phasor Xp by a phase angle of about 45°. The face of the power piston forms a movable wall of the working space, so its movement into and out of the working space causes a periodic power piston pressure wave Pp in the working gas which leads the power piston displacement phasor by a few degrees because of seal leakage. The enclosed charge of working gas in the working space functions as a spring, illustrated on FIG. 7 as the gas spring Kp. The power piston amplitude is related to the damping Dp and Da of the load and also is a function of the engine pressure, the volume swept by the displacer, and the phase angle which in turn is influenced by the damping Dd on the displacer. This relationship is important for control purpose, as will be discussed below.

The motion of the displacer 28 within the working space does not change the volume of the working space, but the displacer post 116 moving into and out of the gas bearing 104 does cause a small change in the working space volume which gives rise to a small pressure wave in phase with the displacer motion. The displacer motion also produces a second effect which is more significant, namely, a large temperature induced pressure wave. This pressure wave, less the small displacer post volume induced pressure wave, is shown in FIG. 8 as a displacer pressure phasor Pd.

The compression space pressure phasor Pc which is the vector addition of Pp, Pd, is the pressure wave which actually exists in the engine compression space during operation. This pressure phasor Pc has a corresponding force phasor $Fp = PcAp$ which is 180° out of phase with the pressure phasor Pc and is exerted on the power piston to produce output work and to function as the engine spring Kp.

The power absorbed and produced is proportional to the component of the force phasor which is normal to the displacement vector; the component which is parallel to the displacement vector functions as a spring, absorbing energy and then returning it to the moving element.

The forces on the power piston are resolved in the phasor diagram of FIG. 8. The engine compression space pressure wave Pc results in a force Fp acting on the full face of the power piston and 180° out of phase with the pressure wave. The force Fg of the power piston gas spring $K_L$ also acts on the power piston, as does the combined load reaction force $F_L$. Each of these forces has a spring component which is parallel to the power piston displacement vector Xp, and a work component normal to vector Xp. The spring component represents energy stored in the gas and later returned to the power piston. The work component represents work done by the power piston, either through hysteresis losses or through useful work on the alternator or compressor.

The forces on the displacer are also resolved in FIG. 8. The forces Fd on the displacer exerted by the engine working gas pressure on the differential area between the displacer hot and cold faces (i.e., the displacer post area Ar) is the force phasor Fd-PcAr. In addition, the pressure drop across the heat exchangers acting on the face of the displacer exerts a damping force $Dd = \Delta PAd$. The displacer gas spring Kd exerts a spring force $-KdXd$ which is 180° out of phase with the displacer displacement vector Xd, and consumes energy in the form of hysteresis, leakage, and bearing losses, all of which are approximated by the expression CdVd. The force diagram is completed by the inertia component $Md\ \omega^2Xd$.

The angle T by which the engine compression space pressure phasor lags the power piston displacement vector Xp is called the engine pressure angle. At constant power, an engine with a low engine pressure angle, on the order of 15° for example, will have a higher peak-to-peak pressure ratio in the engine working gas than an engine with a higher pressure angle, on the order of 45° for example.

A high peak-to-peak pressure ratio is thermodynamically undesirable because it results in higher temperature variations in the working gas in the compression and expansion spaces and therefore, higher thermal mixing and thermal entry losses. The pressure angle is, in part, a function of the phase angle between the displacer and power piston displacements, and the useful range of displacer phase angles that may be used is often limited to between 30°-60° because the phase angle is one of the primary determinants of engine power. This range does not apply to all engine configurations, but each engine configuration will have its own range of useful phase angles. In a free piston engine, the phase angle is affected by the operating dynamics, viz; the mass Md and volume swept by the displacer, the spring and damping constants of the displacer gas spring, the area Ar of the displacer post, the pressure drop $\Delta P$ across the heat exchangers, the mean engine pressure, and the temperature difference between the heater and cooler. A change in any of these parameters affects more than just the displacer phase angle, and therefore it is necessary to optimize the entire system with a control system that will produce the desired engine power and efficiency within the range of useful displacer phase angles.

Figure 9:
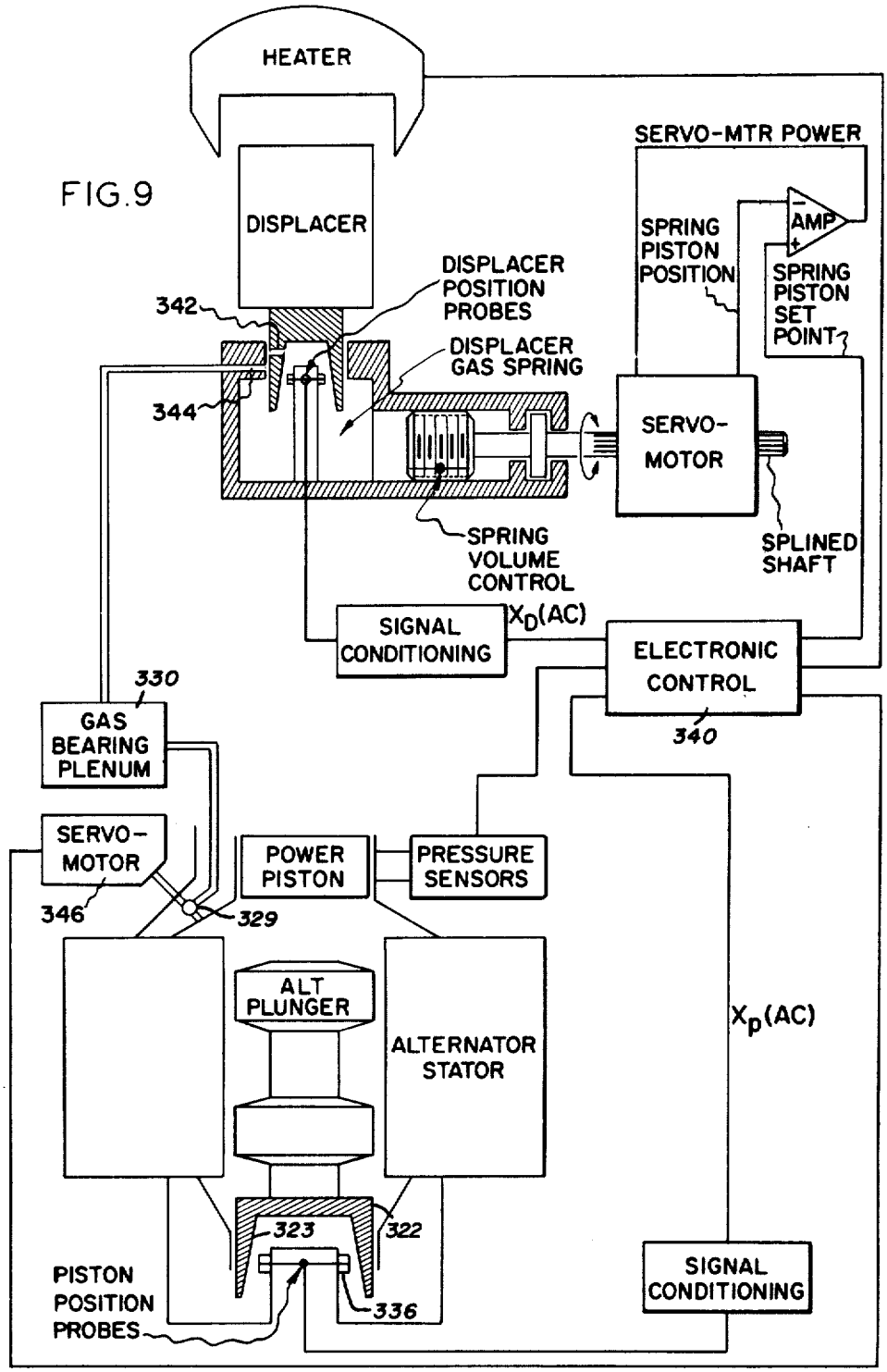
FIG. 9 is a schematic diagram of the control system.
Figure 10A:
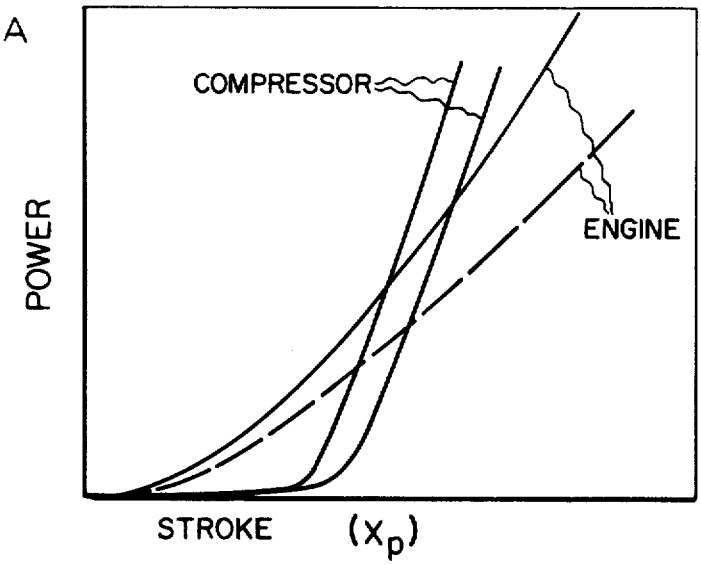
FIGS. 10A and 10B are graphs of performance characteristics of the engine.
Figure 10B:
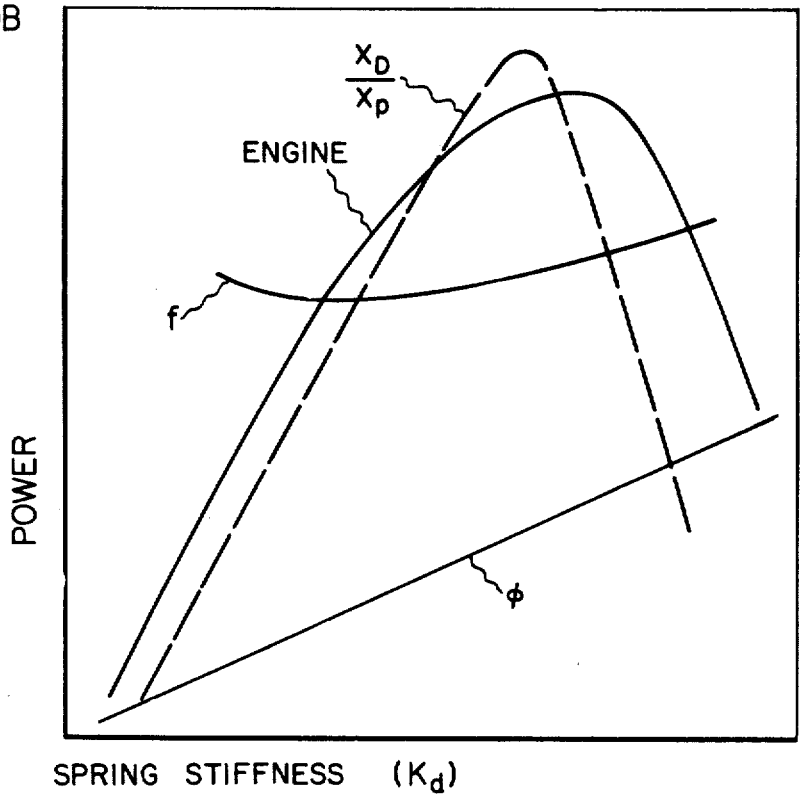

The control system, shown schematically in FIG. 9, adjusts the operating parameters of the engine to achieve stability and power control. An engine driving an alternator or driving an alternator and compressor as shown in the disclosed embodiment of this invention, can become unstable when the engine exponent is close to or greater than the load exponent. The engine and load exponents determine the slope of the power-stroke curves, two of each shown in FIG. 10A. If the engine component is greater than the load exponent and some perturbation causes the engine stroke to rise; the engine power will exceed the load draw and the engine stroke will continue to increase. Likewise, when the engine stroke decreases, the engine power decreases faster than the load power and the engine shuts down. Since the engine exponent in the disclosed engine is slightly affected by engine frequency and strongly affected by phase angle and the ratio of displacer to power piston stroke amplitude, as shown in FIG. 10B, one way of bringing the engine and load exponents into consonance is to set the engine operating point at a phase angle and stroke amplitude ratio slightly below the point of highest engine exponent, on the rising slope of the power versus spring stiffness curve of FIG. 10B. In this way, the engine operating parameters can be adjusted to match the power draw of the load and do so with stable operation. That is, when the load decreases, the power piston stroke tends to increase and lower the stroke amplitude ratio, thereby dropping the power. In addition, the decreased power piston damping decreases the phase angle. These two factors, operating on the rising slope of the curve, tend to drop the engine power and maintain the engine in a stable condition. Concurrently, of course, the fuel flow into the combustor, which is supplying heat to the heater head, is reduced. However, the thermal inertia in the heater head introduces a thermal lag which must be accommodated, and it is for this purpose that the fast response control system is needed.

The adjustment of engine power to match the load power draw is the other important factor in selecting the engine operating parameters. The engine power control is a fast response system to enable the engine to follow sudden changes in load that must be accommodated while the slower responding heat input system can increase the mean heat power input into the working gas. In addition, the power control system ensures that the power delivered to the load satisifies but does not exceed the demand, and that the power is allocated correctly between the compressor and the alternator, according to demand. These functions are accomplished primarily by adjustments to the stiffness and damping of the several gas springs in the machine, by amount and distribution of energy feedback into the power conversion components, and by control of phase angles and frequency of the moving elements.

The heat input is controlled by controlling the fuel flow into the combustor according to the head temperature to maintain a uniform head temperature. In addition, a slightly faster combustor response time may be achieved by utilizing a direct indication of load, as sensed by an alternator armature stroke sensor 336 mounted on the centering post 316 and coacting with the tapered bore 323 in the armature end cap 322 in the same manner as the displacer stroke sensor. The armature stroke information can be used to influence fuel flow to the combustor. The sensor 336 produces an AC signal whose amplitude varies with the stroke and whose frequency varies with the power piston frequency. The sensor signal is fed to a microprocessor 340 which is programmed to produce set points for the heater fuel control, for the stiffness and damping of the several gas springs, and for the energy feedback parameters for all conditions and distributions of load between the compressor and alternator. These setpoints are achieved virtually instantaneously, that is, within a single cycle of the machine by the fast acting adjustments described below.

The gas spring volume control is a two step system, including a gross adjustment and a fine adjustment. The gross adjustment is a releasable clamp which grips the threaded shell of the gas spring volume adjustment piston and rotates with it, but can be released to slide axially within the shell. Thus when a gross adjustment to the gas spring volume is needed, the clamp is released and the piston body slides freely in the shell according to the pressure on the opposite faces of the piston. When it is desired to decrease the gas spring volume, the clamp is released near the top of the displacer stroke when the pressure is low, and the piston will be drawn into the gas spring space. The clamp is then reengaged and the displacer spring servomotor is activated to adjust the gas spring volume to the precise set point set by the microprocessor.

An energy feedback system permits feedback of energy from the energy conversion devices to prevent overloading the engine to the extent that it shuts down before the heat input system can catch up to the energy demand. The feedback system for the compressor includes a controllable valve between the high and low pressure sides of the compressor that can be adjustably opened to allow a controlled flow back into the low pressure side. This provides a means for loading the compressor gradually, over a few cycles of the engine, to permit the engine to respond with greater power output. The response time of this control is less than a single engine cycle so it is useful as a short term load take-up adjustment.

The corresponding feedback system for the alternator is a control for diverting a portion of the alternator output power into the alternator stator field windings. The effect of this scheme is to make the load appear smaller than it is, or more precisely to make the power output appear greater than it is. The feedback is used only until the long term or mean condition system can respond with greater heat input and correct phase angle.

The damping of the displacer is controlled by a porting system that works in conjunction with the power piston gas spring. The high pressure plenum 330 is connected to the displacer gas spring volume through a set of ports 342 in the displacer post 116 and 344 in the gas bearing 104 which align at about midway between the midstroke and end-of-stroke position. The spring force on the high pressure check valve 329 is controlled by a servomotor 346 controlled by the microprocessor. In periods of high load, the check valve 329 is set to supply the gas bearing supply plenum at or above the pressure in the displacer gas spring at the point that the displacer gas spring ports open, in which event there is no pumping by the displacer through its gas spring. In periods of low load, the check valve servomotor stiffens the spring in the check valve 329, reducing the gas flow from the power piston gas spring into the gas bearing supply plenum so that its pressure falls below the displacer gas spring pressure at port alignment so the displacer commences to pump through its gas spring. This is a damping load on the displacer which tends to reduce the displacer stroke amplitude and reduce the power to conform to the load requirements.

Obviously, numerous modifications and variations of the disclosed embodiments are possible in view of the teachings herein. For example, the power piston could be attached rigidly to the alternator and the alternator gas spring used to pressurize the gas bearings. This would simplify the design and control system. Therefore, it is expressly to be understood that these modifications and their equivalents may be practiced while remaining within the spirit and scope of the appended claims, wherein

I claim:

1. In a Stirling engine having a vessel enclosing a charge of working gas in a working space heated by a heater at one end and cooled by a cooler at the other end, and containing a displacer piston which reciprocates axially in the working space to shuttle the working gas between the heater and cooler to generate a periodic pressure wave in the working gas which drives a power piston for axial reciprocation in the vessel, the improvement comprising:

a tapered surface on one of said pistons, said surface forming a small angle with the direction of movement of said one piston;

a proximity sensor closely spaced from said tapered surface and having a sensing surface facing said tapered surface for sensing the width of the gap between said sensing surface and said tapered surface;

whereby each axial position of said one piston has a corresponding unique gap between said sensing surface and said tapered surface which gap can be measured by said proximity sensor and related to the axial position of said one piston.

2. The invention defined in claim 1, wherein said proximity sensor is mounted on structure that is fixed with respect to said vessel.

3. The invention defined in claim 2, wherein said sensor is mounted on a mounting post mounted coaxially to said vessel, and said tapered surface is on the displacer piston on a telescoping coaxial displacer post attached to and axially reciprocating with said displacer piston with respect to said mounting post.

4. The invention defined in claim 3, wherein said sensor includes a pair of proximity probes disposed diametrically apart on said mounting post to detect and compensate for lateral misalignment of said displacer post and said mounting post.

5. The invention defined in claim 3, wherein said displacer post is tubular in form and said mounting post is concentrically arranged within said displacer post and has an external diameter which is smaller than the internal diameter of said displacer post.

6. The invention defined in claim 1, wherein the sensing surface of said sensor is disposed parallel to said tapered surface.

7. The invention defined in claim 1, wherein:

said one piston reciprocates with the power piston;

said proximity sensor includes a pair of proximity probes disposed diametrically apart on a post that is fixed with respect to said vessel and telescopingly arranged within a bore in said piston;

said tapered surface being formed on the inside wall of said bore.

8. A method of operating a stable free piston Stirling engine having a hermetic vessel defining therein a working space in which oscillates a displacer and a power piston, said power piston driving a power conversion device which drives a load; spring elements associated with said displacer and said power piston; a heater and a cooler for heating and cooling, respectively, a charge of working gas enclosed in said vessel; a regenerator for storing heat; a gas flow path for conveying the working gas when displaced by said displacer through said heater, said regenerator and said cooler to execute a thermodynamic cycle; the method comprising:

selecting an operating point for the normal operation of said engine at a point on the power versus spring stiffness characteristic curve which is lower than the peak of said curve; and changing the engine operating frequency upon the load changing to selectively increase or decrease the power to avoid the occurrence of an unstable situation.

9. The method defined in claim 8, wherein said selecting comprises selecting the mass of said displacer, the mass of said power piston and the spring constants of said spring elements in said engine to produce a resonant system, damped by the load, that resonates at a selected frequency.

10. The method defined in claim 8, wherein said normal operating point is near the top of said power versus spring stiffness characteristic curve.

11. The method defined in claim 8, further comprising, changing said normal operating point upon said load changing to follow the power requirements of said load.

12. The method defined in claim 8, further comprising: changing said normal operating point by adjusting the engine frequency to change the engine power to match the engine load demand.

13. The method defined in claim 12, wherein said engine frequency is changed by changing the spring rate of at least one of said spring elements in said engine.

14. A method of operating a stable free piston Stirling engine having a hermetic vessel defining therein a working space in which oscillates a displacer and a power piston driving a load; spring elements associated with said displacer and said power piston; a heater and a cooler for heating and cooling, respectively, a charge of working gas contained in said vessel; a regenerator for storing heat; a gas flow path for conveying the working gas when displaced by said displacer through said heater, said regenerator and said cooler to execute a thermodynamic cycle; the improvement comprising:

selecting the phase angle and stroke amplitude ratio ($X_d/X_p$) of the displacer and power pistons such that the normal operating point is on the rising slope of the power versus spring stiffness characteristic curve of the engine and below the point of highest engine power output.

15. In a Stirling engine having a hermetically sealable vessel enclosing a charge of working gas in a working space heated by a heater at one end and cooled by a cooler at the other end, and containing a power piston and a displacer piston which is mechanically and frictionally independent of said power piston and which reciprocates axially in the working space to shuttle the working gas between the heater and cooler to generate a periodic pressure wave in the working gas which drives the power piston for axial reciprocation in the vessel, the improvement comprising:

a closed, variable volume gas chamber in said vessel defined by a stationary surface fixed with respect to said vessel and a surface fixed with respect to said displacer, so the chamber volume changes upon said displacer being moved relative to said vessel, changing the pressure of the gas in said chamber and exerting a pressure force on said surfaces which varies with the axial position of said displacer, thereby forming a gas spring between said displacer and said vessel;

sensor means for detecting an undesirable condition in at least one of the engine phase angle and the displacer stroke amplitude, and producing a signal indicative of said condition;

control means for receiving the signal from said sensor and producing a correction signal;

means for adjusting the pressure of the gas in said chamber in accordance with said correction signal whereby the spring stiffness of said gas spring may be adjusted to adjust the dynamics of the engine.

16. The invention defined in claim 15, wherein said volume adjusting means includes a cylinder and an adjustment piston relatively movable therein, said cylinder being in gas communication with said gas spring chamber, whereby movement of said adjustment piston relative to said cylinder changes the effective volume of said gas spring.

17. The invention defined in claim 16, wherein said adjustment piston is threaded into said cylinder and is moved axially therein by rotation about its axis.

18. The invention defined in claim 17, further comprising a motor coupled to said piston for rotating said piston about its axis.

19. The invention defined in claim 16, wherein said adjusting means includes a gross adjusting means and a fine adjusting means; said gross adjusting means including a releasable clamp for releasing said piston for large scale travel in said cylinder.

20. In a Stirling engine having a hermetically sealable vessel enclosing a charge of working gas in a working space heated by a heater at one end and cooled by a cooler at the other end, and containing a power piston and a displacer piston which is mechanically and frictionally independent of said power piston and which reciprocates axially in the working space to shuttle the working gas between the heater and cooler to generate a periodic pressure wave in the working gas which drives a power piston for axial reciprocation in the vessel against the return spring action of at least one gas spring, the improvement comprising a power control including:

sensor means for sensing the effective stroke of said power piston and the phase angle thereof with respect to the displacer piston motion, and producing a signal representative thereof, thereby to detect and signal changes in the power demand on said engine; and adjustment means for changing the dynamics of said displacer in said working space in response to said signal to adjust the angle by which said displacer motion leads said power piston motion to cause said engine power to be adjusted to correspond to the power demand.

21. The system defined in claim 20, wherein said adjustment means includes:

means for detecting the phase relationship of said power piston and said displacer piston and producing a signal indicative of said phase relationship; and means for changing the spring constant of said at least one gas spring in response to said signal to shift said phase relationship and reduce the total mass-spring system inertial force transmission to said vessel.

22. A stable free piston Stirling engine having a hermetic vessel in which oscillates a displacer and a power piston, a power conversion device driven by said power piston for driving a load; a heater and a cooler for heating and cooling, respectively, a charge of working gas enclosed in said vessel; a regenerator for storing heat; a gas flow path through which the working gas can flow when displaced by said displacer through said heater, said regenerator and said cooler to execute a thermodynamic cycle, the improvement comprising:

a displacer gas spring between said displacer and said vessel;

said charge of working gas in said working space constituting an engine gas spring for said power piston; and adjustment means for adjusting the relative exponent of said engine and said load as said load changes to maintain a predetermined relationship between said engine exponent and said load exponent where the engine and load exponents are defined as the slope of the power-stroke characteristics of the engine and the load, respectively, over the operating range in question.

23. The free piston Stirling engine defined in claim 22, wherein said engine exponent adjusting means comprises:

means for adjusting the resonant frequency of said engine to change the power produced per cycle to correspond to the power drawn per cycle of said load.

24. The free piston Stirling engine defined in claim 23, wherein said engine frequency adjusting means includes a piston movable in a cylinder that communicates with said displacer gas spring, and a quick release mechanism for causing a sudden movement of said piston in said cylinder to create a sudden change in the volume of said gas spring;

whereby said engine frequency and the engine power produced per cycle can both be increased and decreased when the load power demand increases and decreases, respectively, to maintain engine stability.

25. The engine defined in claim 22, wherein said exponent adjusting means includes:

sensing means for effectively sensing the stroke of said power piston;

set point means for setting the optimum operating parameter of piston stroke and piston/displacer phase angle as a function of load;

sensing means for sensing the stroke of said displacer;

comparator means for comparing the piston and displacer strokes and phase angle with said optimum operating parameters, and generating error signals when the actual conditions deviate from said optimum conditions; and means responsive to said error signals to bring said actual conditions into conformity with said optimum conditions.

26. The engine defined in claim 22, wherein said adjusting means includes an adjustable damper on said displacer to withdraw excess energy fed into said displacer during periods of sudden decreases of load.

27. The engine defined in claim 22, wherein said adjusting means includes a non-linear displacer spring which decreases in stiffness with increasing stroke.

28. The engine defined in claim 22, wherein said adjusting means includes means for adjusting the phase angle of said displacer and said power piston when the load changes, to increase the phase angle when the load decreases to decrease the power feedback from the power piston into the displacer.

29. The engine defined in claim 28, wherein said phase angle adjusting means includes an adjustable vent on said displacer gas spring, adjustable to decrease the displacer spring constant when said displacer stroke amplitude exceeds a predetermined set value.

30. The engine defined in claim 22, wherein said adjustment means includes means for harmonizing the displacer damping with the damping effect exerted by the load to maintain the desired phase angle.

31. The engine defined in claim 22, wherein said adjustment means includes means for feeding a portion of said engine output power back via said power conversion device whereby the power conversion device appears as a smaller load on the engine.

* * * * *